United States Patent [19]

Sukigara

[11] Patent Number: 4,897,694

[45] Date of Patent: Jan. 30, 1990

[54] PERFORATION HOLE IMAGE, ELIMINATING COPYING MACHINE

[75] Inventor: Katsushi Sukigara, Osaka, Japan

[73] Assignee: Minolta Camera Kabushiki Kaisha, Osaka, Japan

[21] Appl. No.: 209,644

[22] Filed: Jun. 21, 1988

[30] Foreign Application Priority Data

Jun. 24, 1987 [JP] Japan ..... 62-157237

[51] Int. Cl.[4] ..... G03G 15/00

[52] U.S. Cl. ..... 355/218; 355/219

[58] Field of Search ..... 355/7, 3 R, 14 R

[56] References Cited

U.S. PATENT DOCUMENTS 4,256,400 3/1981 Komori et al. .
4,575,227 3/1986 Ito et al. .
4,582,417 4/1986 Yagasaki et al. .
4,627,707 12/1986 Tani et al. .
4,655,580 4/1987 Watanabe et al. .
4,728,985 3/1988 Nakashima ..... 355/7
4,745,489 5/1988 Kashiwagi et al. ..... 355/7 X

FOREIGN PATENT DOCUMENTS 60-22148 2/1985 Japan .

*Primary Examiner*—R. L. Moses
*Attorney, Agent, or Firm*—Burns, Doane, Swecker & Mathis

[57] ABSTRACT

A copying machine which forms the whole image of an original onto a photosensitive drum is provided with an image control means for properly functioning not to form images of both end portions of an original.

Either the whole image of an original or the portions of image which excludes both end portions is formed onto the photosensitive drum depending on whether the image control means is operated or not.

4 Claims, 7 Drawing Sheets

PERFORATION HOLE IMAGE, ELIMINATING COPYING MACHINE

BACKGROUND OF THE INVENTION

The present invention relates to a copying machine and, more particularly to a copying machine capable of making a copy by erasing images of perforations aligned on both ends of a paper particularly when making a copy of an original of a computer paper.

With recent rapid automatization in the office environment, such computers as personal computer, minicomputer and office computer have widely been introduced, and in parallel with utilization of such equipment, the work load for making copies of the originals output on a computer paper has been inevitably increasing. However, there have been difficulties in avoiding making ugly copies since the shadow of perforations aligned on the computer paper appeared on the copies reproduced.

In U.S. Pat. No. 4,256,400 and U.S. Pat. No. 4,582,417, the copying machines which is provided with such editing functions as trimming and masking are disclosed.

U.S. Pat. No. 4,256,400 discloses a copying machine which is arranged for designating an area to be copied by two pairs of indicators which are movable along the two intersecting sides of an original support table.

In U.S. Pat. No. 4,582,417, a copying machine is disclosed which is so arranged as to designate an area to be copied by using ten-keys while exposing the other area by an eraser lamp.

By utilizing the means disclosed in U.S. Patents described above, copying an original of the computer paper may be carried, .out by erasing images of aligned perforations. However, it is troublesome for designating an area to be copied, and moreover, equipment provided with such editing function is limited to expensive copying machines.

SUMMARY OF THE INVENTION

The main object of the present invention is to provide a copying machine capable of erasing by simple operation images of perforations aligned on both ends of an original even when computer papers are copied. In order to accomplish the object, the present invention features a copying machine which is provided with an image forming means for forming the whole image of an original placed on an original support table, and it is further provided with an image control means which is properly actuated not to form images of perforations aligned on both end portions of the computer paper on a photosensitive drum.

Further objects and advantages of the present invention will be apparent from the following description, reference being had to the accompanying drawings wherein preferred embodiments of the present invention are clearly shown.

DETAILED DESCRIPTION OF PREFERRED EMBODIMENT

An embodiment of the present invention will now be described with reference to the accompanying drawings.

Figure 3:
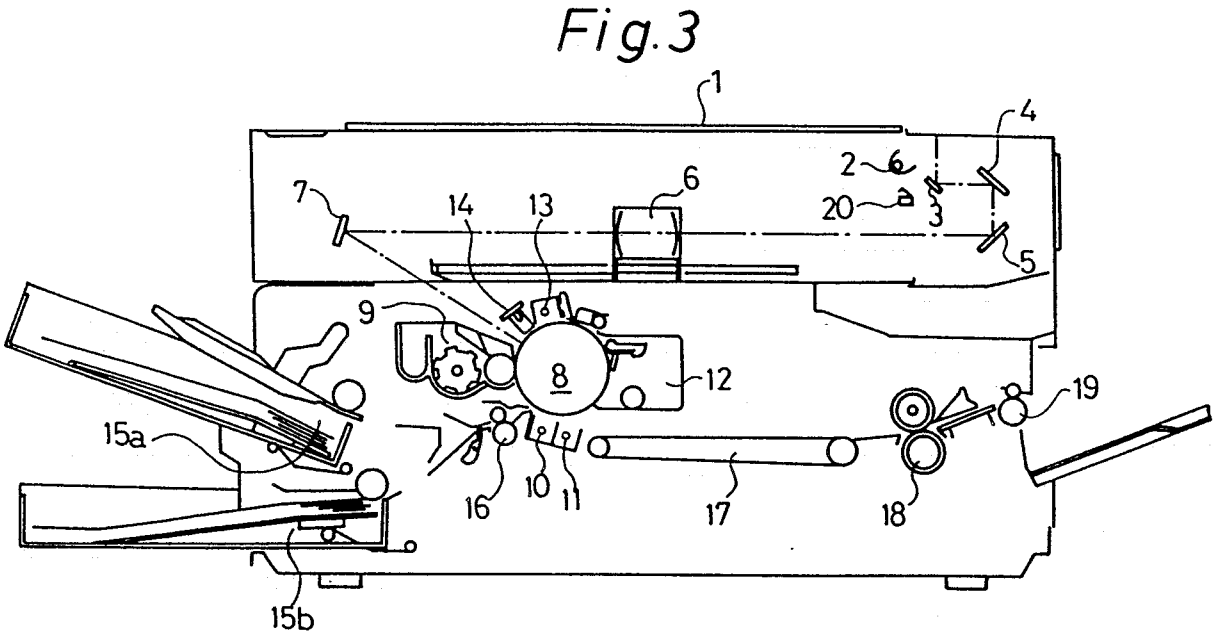
FIG. 3 is a schematic view of an electrophotographic copying machine which is provided with the operation panel and the control circuit of FIGS. 1 and 2.

FIG. 3 is a sectional view of an electrophotographic copying machine. In FIG. 3, designated by 1 is an original support table, 2 light source, 3 first mirror, 4 and 5 second and third mirrors. Scanning is done when the light source 2 and the first mirror 3 move together along the under surface of the original support table 1. It is so arranged that even the second and the third mirrors 4,5 move coincidently with the first mirror 3 in half the length of the first mirror 3 for scanning, a predetermined optical length is maintained.

Designated by 6 is projection lens, 7 fourth mirror and 8 photosensitive drum onto which an image of the original scanned is projected through the projection lens 6 and the fourth mirror 7.

Arranged around the photosensitive drum 8 are developing unit 9, transfer charger 10, separation charger 11, cleaner 12, charger 13 and suberaser 14.

Shown by numerals 15*a*, 15*b* are paper feed sections, 16 register rollers, 17 conveyor, 18 fixing section, 19 discharge rollers and 20 the switch which detects when the first mirror 3 reaches the leading end of an original.

Figure 4:
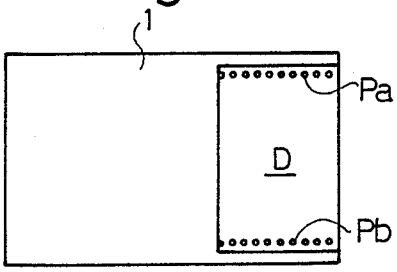
FIGS. 4 and 5 are plan view of original support tables of the copying machine shown in FIG. 3 illustrating two embodiments in which two originals which possess perforations aligned on both ends are placed on each of the original support table.
Figure 5:
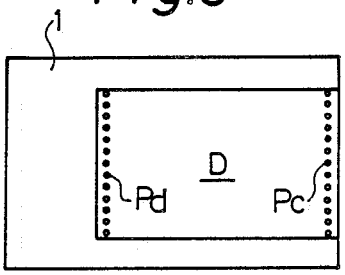
Figure 6:
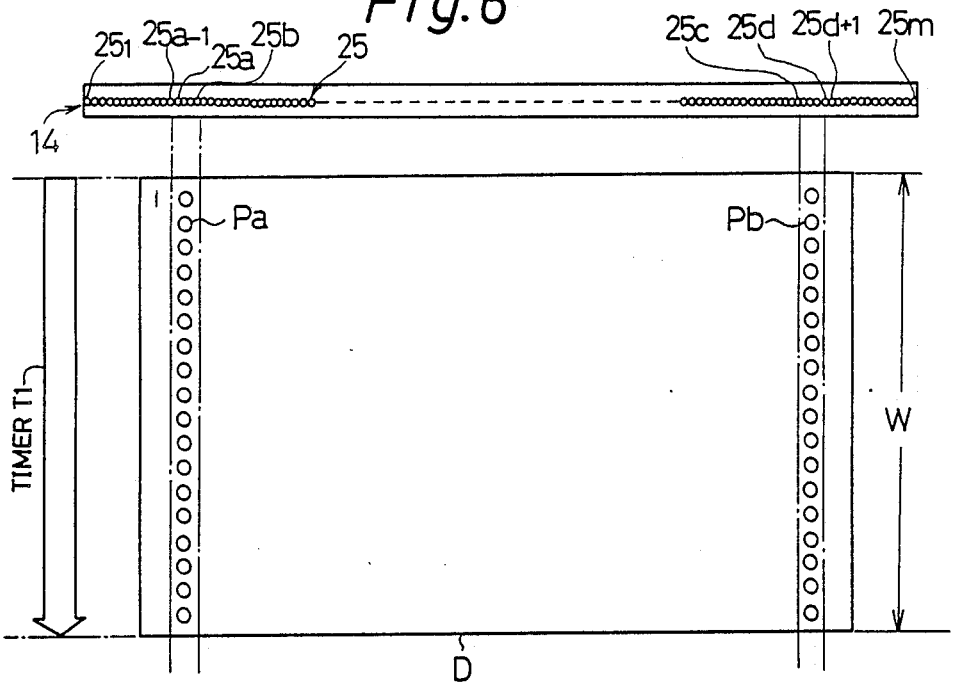
FIG. 6 shows behavioral relations between the original placed as shown in FIG. 4 and an eraser which erases the images of perforations aligned.
Figure 8:
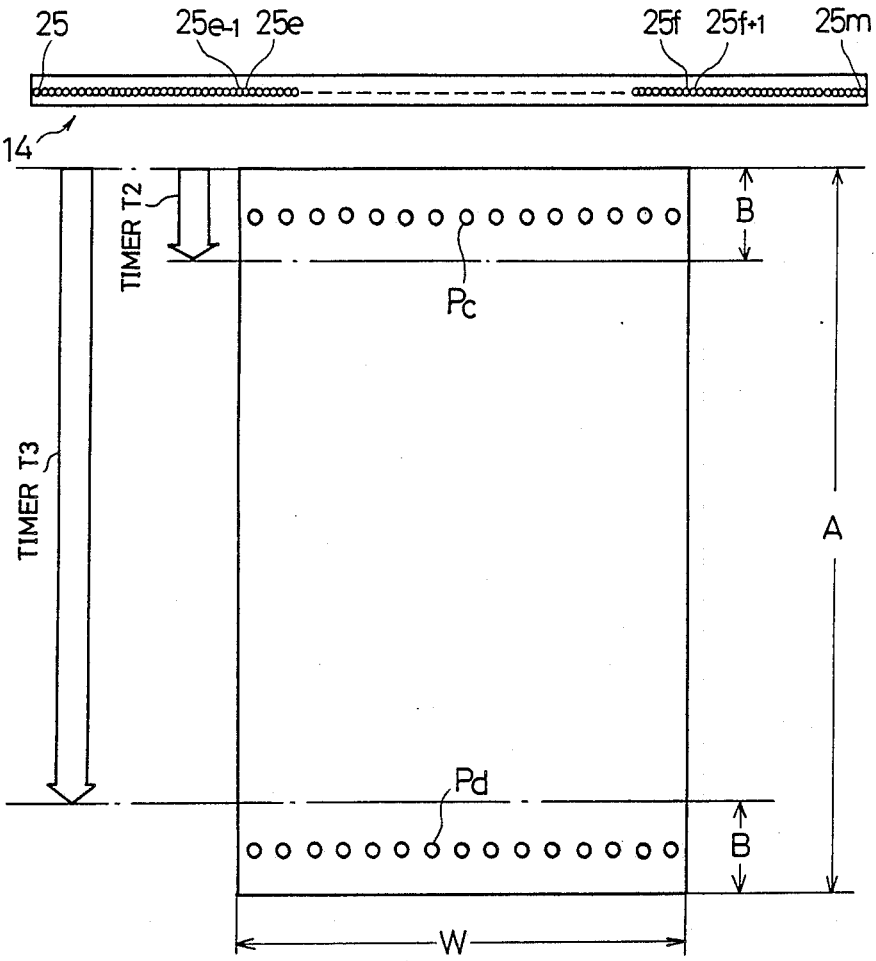
FIG. 8 shows behavioral relations between the original placed as shown in FIG. 5 and an eraser which erases the images of perforations aligned.
Figure 11:
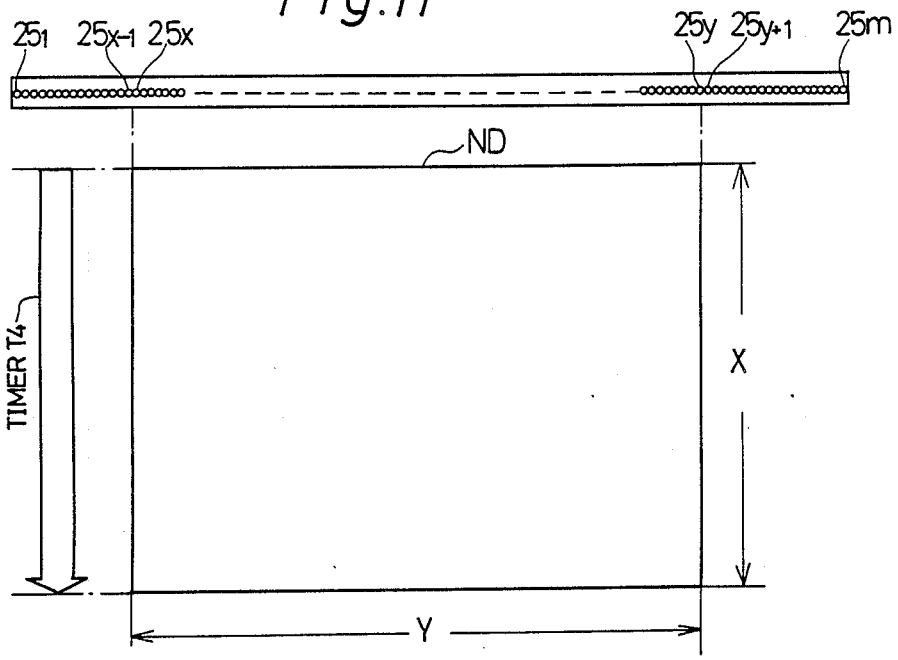
FIG. 11 shows the original of FIG. 10 and an eraser how it is actuated when reproducing the whole image of the original.

The suberaser 14 consists of a multiplicity of LEDs $24_1$–$24_m$ arranged in an alignment as illustrated in FIGS. 6, 8 and 11, and the LED is so designed as to control the lighting of any LED thereby electric charge on any desirable area of the photosensitive drum 8 can be eliminated. By making use of the eraser 14, unnecessary portion of image of an original, i.e., the images of aligned perforations of computer paper Pa-Pb and Pc-Pd as illustrated in FIGS. 4 and 5 can be eliminated from reproduced images.

Figure 1:
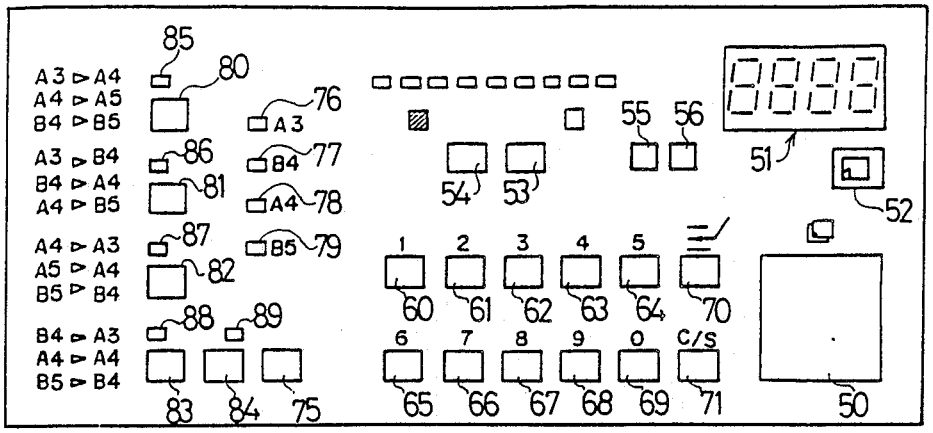
FIG. 1 is a plan view illustrating an operation panel of an electrophotographic copying machine in an embodiment of the present invention.

FIG. 1 illustrates an operation panel of an electrophotographic copying machine. Disposed in the operation panel are print key 50 for starting copying operation, digital display device 51 capable of displaying a numerical figure comprised of up to four digits, paper-empty indicator 52, up and down keys 53, 54 for adjusting the density of images to be reproduced, mode selecting key 55 for selecting a mode to erase the images of perforations of computer paper aligned Pa-Pb, selecting key 56 for designating the direction depending on how the original D on the original support table 1 is placed as shown in FIGS. 4 and 5, ten keys 60–69, interruption key 70, clearstop key 71, paper size selecting key 75, paper size indicators 76–79, selection keys 80–84 and indicators 85–89 for selecting variable magnification and the same-size magnification.

Figure 2:
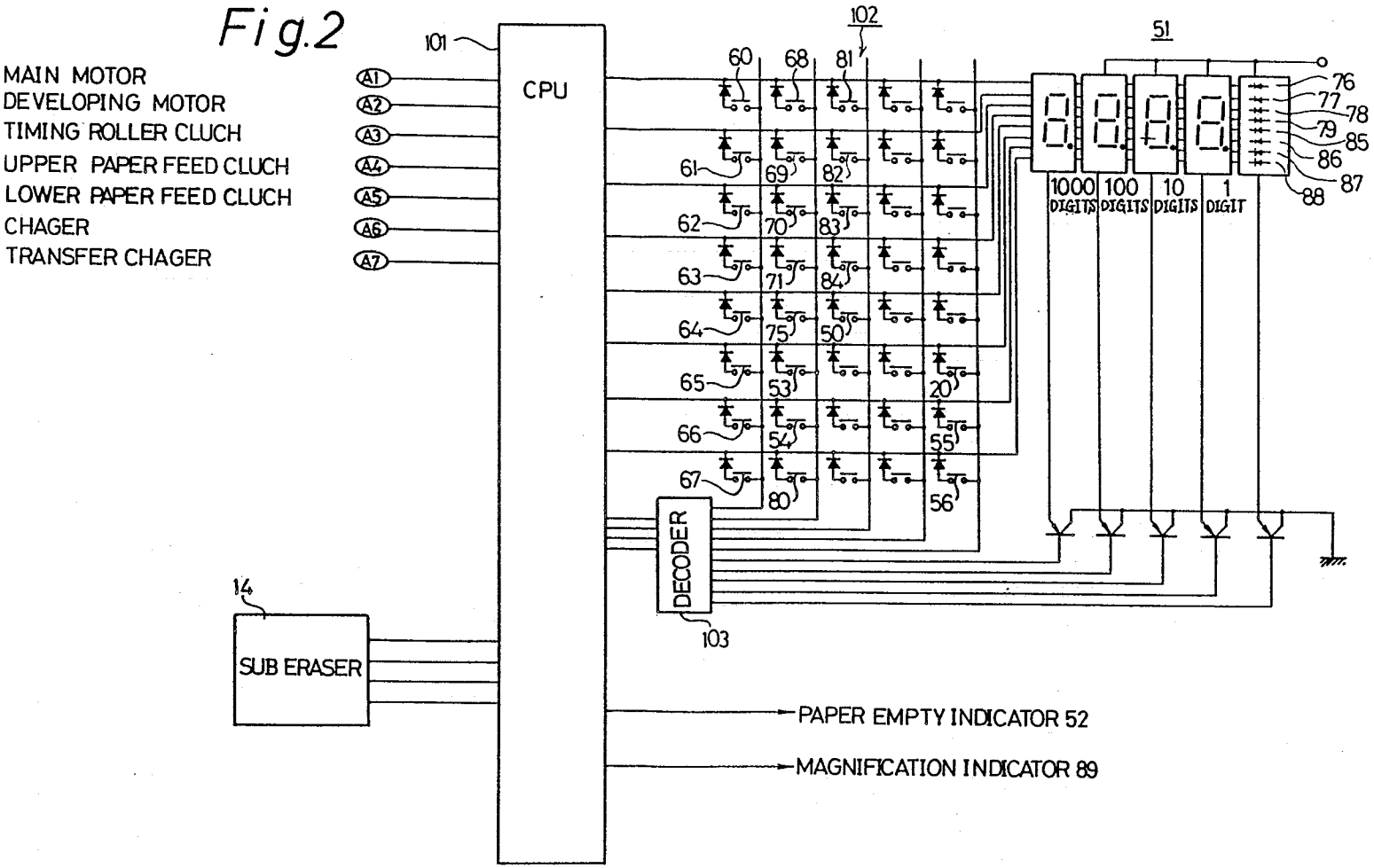
FIG. 2 is a control circuit diagram of an electrophotographic copying machine illustrating how keys and indicators are connected in the operation panel shown in FIG. 1.

FIG. 2 illustrates a control circuit. CPU 101 of a microcomputer is conneced to a switch matrix 102 in which various operation keys and sensors of the operation panel are disposed longitudinally and latidudinally Output terminals A1–A7 of the CPU 101 are connected to main motor, developing motor, register roller clutch, upper paper feed clutch, lower paper feed clutch, charger and transfer charger. Suberaser 14 is also connected with the CPU 101, and on-off is controlled in accordance with signals from the switch matrix 102. To the CPU 101, digital display device 51 and various indicators 76–79 and 85–88 are connected via decoder 103. The paper empty indicator 52 and the same-size magnification indicator 89 are also connected to the CPU 101 so as to control turning them on and off.

When copying an original of a computer paper, perforation erase mode can be set by pressing mode selecting key 55 with other desirable copying conditions selected. The selecting key 56 is operated depending on how the original D on the original support table 1 is placed, i.e. whether it is placed latitudinally to the direction of original scanning as shown in FIG. 4 or longitudinally to the direction of original scanning as in FIG. 5.

Copying operation then starts by pressing the print key 50 under the condition described above. When the original D on the original support table 1 is placed latitudinally to the direction of scanning as shown in FIG. 4, the LEDs 25*a*–25*b* and 25*c*–25*d* of the suberaser 14 which correspond to the aligned perforations Pa, Pb as shown in FIG. 6 is turned, on, and consequently the images of the aligned perforations is erased forcibly.

Figure 7:
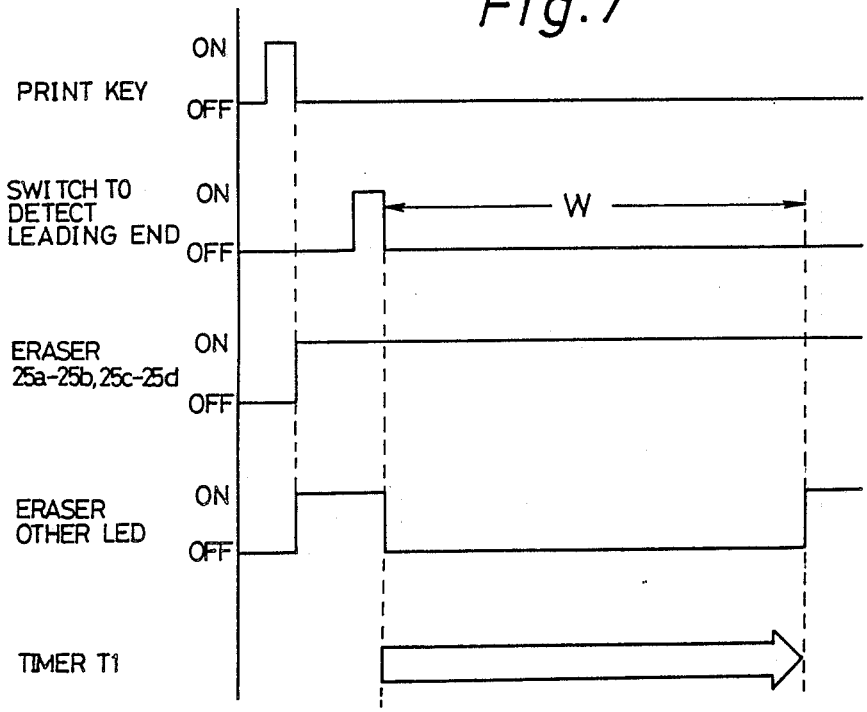
FIG. 7 is a behavior time chart of main device when the erasing operation is carried out as shown in FIG. 6.

In practice, when the print key 50 is pressed and copying is started as illustrated in FIG. 7, all of the LEDs $25_1$–$25_m$ of the suberaser 14 are turned on. When the switch 20 provided for detecting the leading end of an image is turned on following the movement of the first mirror 3, all the other LEDs excepting LEDs 25*a*–*b* and 25*c*–*d* are turned off and timer T1 starts at the same time.

The length of the timer T1 is set in accordnace with the value which corresponds to the width W of an original D. When the timer T1 came to an end, the other LEDs of the eraser are turned on. In other words, the LEDs 25*a*–25*b* and 25*c*–25*d* of the eraser are kept turned on all the time when copying operation is carried out thereby eliminating the image formation of the perforations on both ends of the original D on the photosensitive drum.

An example was shown in which both ends of LEDs $25_1-25_{a-1}$ and $25_{d\,1}-25_m$ of the eraser 14 is turned off while the timer T1 is operating in its timing, however, it may be controlled to turn on-off with the same timing as the LEDs 25*a*–25*b* and 25*c*–25*d*.

When the magnification variation selecting keys 80–83 are pressed for varying copying magnification, the portion corresponding to the aligned perforations Pa-Pb is changed and erased according to the magnification selected.

On the other hand, in case the original D is placed longitudinally to the direction of scanning as illustrated in FIG. 8, the LEDs 25*e*–25*f* of the eraser 14 which corresponds to the width W of an original D controls on-off with predetermined timing while the LEDs $25_1-25_{e-1}$ and $25_{f=}-25_m$ of the eraser 14 are kept turned on all the time when copying operation is carried out.

Figure 9:
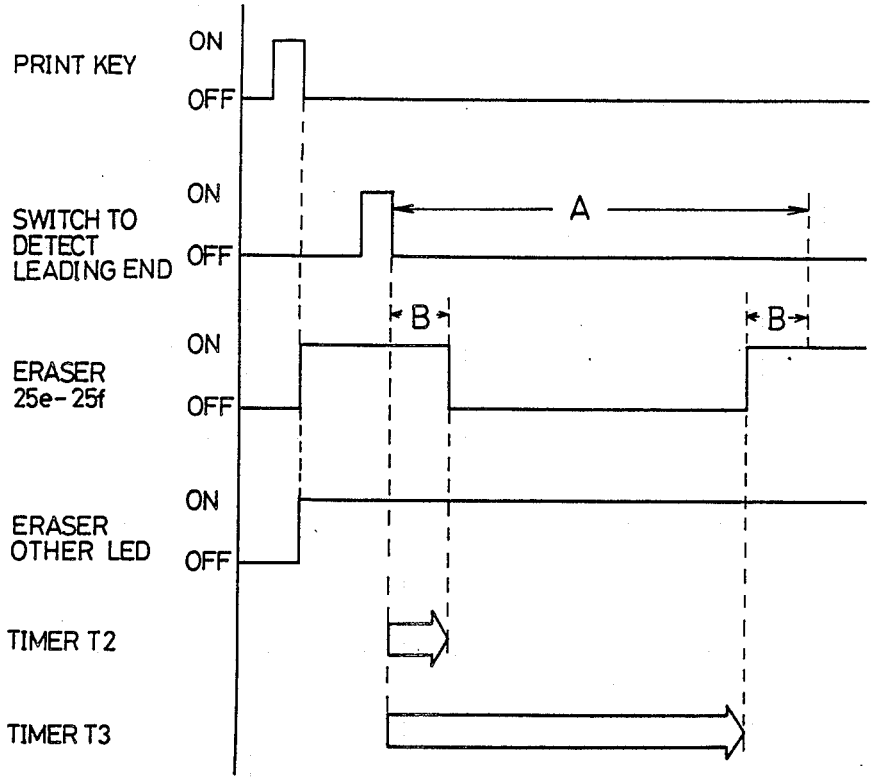
FIG. 9 is a behavior time chart of main device when the erasing operation is carried out as shown in FIG. 8.

In practice, when the print key is pressed and copying is started as shown in FIG. 9, all of the LEDs $25_1$–$25_m$ of the eraser 14 are turned on. When the switch 20 provided for detecting the leading end of an image is turned on following the movement of the first mirror 3, timer T2 starts. The timer T2 is provided to decide the timing for turning off the LEDs 25*e*–25*f*, and the LEDs 25*e*–25*f* are turned off when the timer T2 came to an end. During the timer T2 is in operation, LEDs 25*e*–25*f* eliminate electric charge on the photosensitive drum to prevent image formation in the B area which corresponds to the width of the leading end portion of the original D including the aligned perforations Pc.

Following the switch 20 provided for detecting the leading end of the images is turned on, timer T3 starts. The timer T3 is provided to decide the timing for turning on the LEDs 25*e*–25*f* again, and the LEDs 25*e*–25*f* are turned on when the timer T3 came to an end, and eliminate electric charage on the photosensitive drum to prevent image formation in the B area which corresponds to the width B of the rear end portion of the original D including the aligned perforations Pd. When magnificaiton is changed, the timer value is changed according to the magnification selected to comply with the change in magnification.

Figure 10:
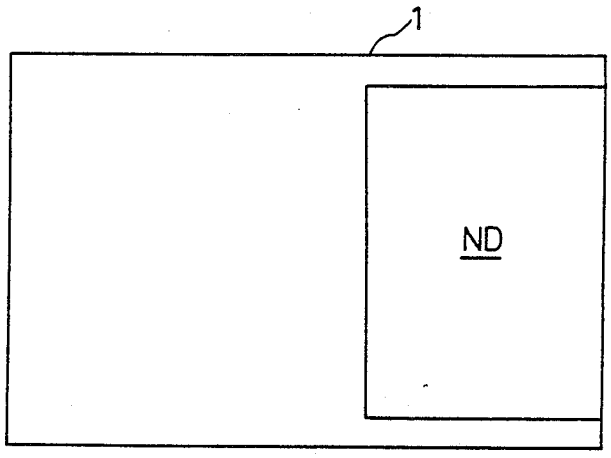
FIG. 10 is a plan view of an original support table illustrating that an ordinary original which has no perforation is placed on the table.

On the other hand, when copying an ordinary original ND placed on the original support table 1 as shown in FIG. 10, the LEDs 25*x*–25*y* of the eraser 14 corresponding to the width Y of the original ND as in FIG. 11 are turned on-off according to predetermined timing, while the LEDs $25_1-25_{x-1}$ and $25_{y+1}-25_m$ of the eraser 14 are kept turned on all the time when copying operation is carried out.

Figure 12:
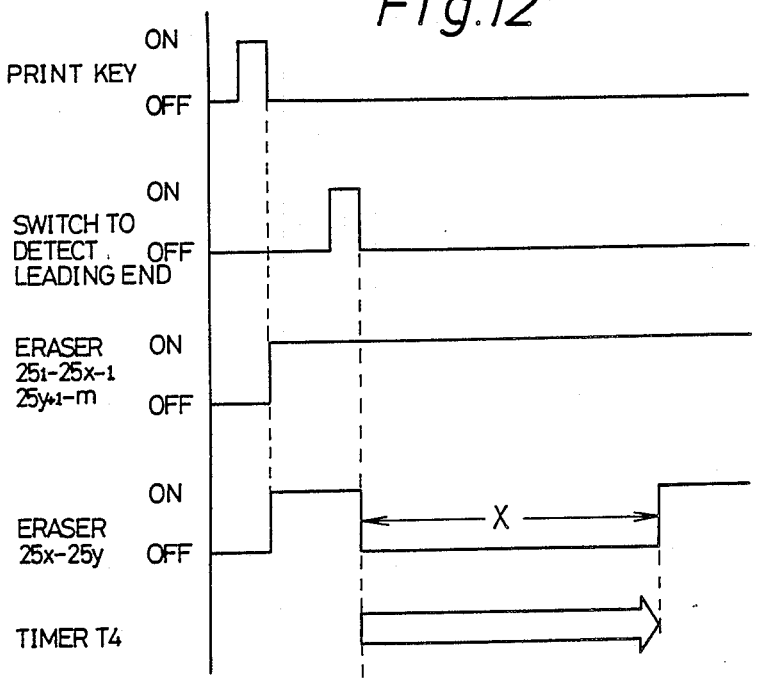
FIG. 12 is a bahavior time chart of main device when the erasing operation is carried out as shown in FIG. 11.

In practice, when the print key is pressed and copying is started as shown in FIG. 12, all of the LEDs $25_1-25_m$ of the eraser 14 are turned on. When the switch 20 provided for detecting the leading end of an image is turned on following the movement of the first mirror 3, the LEDs 25*x*–25*y* of the eraser 14 are turned off and timer T4 starts. The timer T4 is provided to decide the timing for turning on again the LEDs 25*x*–25*y* of the eraser, and the LEDs 25*x*–25*y* are turned on when the timer T4 came to an end. The value of time limit for the timer T4 is set corresponding to the value of length in the scanning direction of the original ND. The whole, image of the original ND is thus formed on the photosensitive drum.

Computer papers of 10" width are generaly used, and the alignment of perforations P is therefore set on the assumption that 10" width computer papers are going to be used for general copying operation. However, computer papers of 15" width are being used for large size computers. Therefore, an embodiment of the present invention is designed for selecting the direction of the paper feeding as well as the size of the computer paper to be copied by the selection key 56.

In case a copying machine is provided with an automatic paper feed device as disclosed in U.S. Pat. No. 4,575,227, it can be designed to automatically select perforation erase mode when the size detected by the original-size detecting means corresponds to the size of a computer paper. In this case, the original-size detecting means serves as mode selecting means.

In the embodiment described above, the suberaser 14 is disposed in front of exposure section, and is designed to erase electric charge before exposure process so as not to form any electrostatic latent image on the portion desired. However, in place of the above method, eraser 14 may be disposed at the back of exposure section and erase the electrostatic latent image formed on the undesirable portion.

The electrophotographic copying machine of the present invention is designed to produce a clean and perforation shadowless copy without having troublesome operation of area selection when copying an original of a computer paper, because once perforation erase mode is selected by a mode selection means, the suberaser 14 is actuated to erase the portion of perforation of an original. The portion of perforations can be used as binding margin for neat filing.

The embodiment described above has been mentioned only of the paper having perforations on both sides in the longitudinal direction, however, it can also be applied to the paper having perforations on both sides at right angle to the longitudinal direction.

What is claimed is:

1. A copying machine which makes copies of an original having first row of perforations aligned on one end of the original and second row of perforations aligned on the other end of the original, comprising:

a photosensitive drum movable in a predetermined direction;

means for charging the photosensitive drum;

means for forming an electrostatic latent image onto the electrified photosensitive drum by projecting the images of the original;

means for irradiating the surface of the photosensitive drum corresponding to the first and second rows of perforations of the original for predetermined time so as to eliminate the electric charge corresponding to the first and second row of perforations of the original; and means for varying said predetermined time in accordance with the size of the original.

2. A copying machine, comprising:

an original support table;

a photosensitive drum;

image forming means for forming the image of an original placed on the original support table onto the photosensitive drum;

image control means for controlling said image forming means so as not to form the images corresponding to a predetermined width of both ends of the original placed on the original support table on the photosensitive drum;

mode selecting means for selecting either one of ordinary or specific mode; and controlling means for actuating the image forming means without actuating the image control means when said ordinary mode is selected, and for actuating both the image forming means and the image control means when said specific mode is selected

3. A copying machine, comprising:

a photosensitive member;

first means for forming the image of an original onto the photosensitive member;

second means for controlling said first means so as to not form the images corresponding to a predetermined width of both ends of the original on the photosensitive member;

mode selecting means for selecting either one of ordinary or specific mode; and controlling means for actuating the first means without actuating the second means when said ordinary mode is selected and actuating the first and second means when said specific mode is selected.

4. A copying machine as claimed in claim 3, wherein:

said first means including means for charging the photosensitive member; and said second means including an irradiating means for irradiating the photosensitive member corresponding to the predetermined width of both ends of the original so as to eliminate the electric charge corresponding to the predetermined width of both ends of the original.

* * * * *